United States Patent [19]

Hirose et al.

[11] Patent Number: 5,029,058

[45] Date of Patent: Jul. 2, 1991

[54] FOCUSABLE AND ADJUSTABLE REMOTE-CONTROLLED LIGHTING DEVICE

[75] Inventors: Hideto Hirose; Hiroaki Yamai, both of Tokyo, Japan

[73] Assignee: Sanshin Dengu Mfg. Co., Ltd., Tokyo, Japan

[21] Appl. No.: 475,488

[22] Filed: Feb. 7, 1990

[30] Foreign Application Priority Data

Feb. 7, 1989 [JP] Japan ..... 1-28057

[51] Int. Cl.[5] ..... F21V 21/14

[52] U.S. Cl. ..... 362/288; 362/233; 362/263; 362/269; 362/287

[58] Field of Search ..... 362/35, 233, 263, 269, 362/272, 282, 284, 285, 286, 386, 418, 288, 287

[56] References Cited

U.S. PATENT DOCUMENTS

| | | | |
|---|---|---|---|
| 4,353,110 | 10/1982 | Ellis | 362/233 X |
| 4,598,345 | 7/1986 | Kleeman | 362/233 |
| 4,729,077 | 3/1988 | Gordin et al. | 362/350 X |
| 4,890,207 | 12/1989 | Jones | 362/233 |
| 4,899,267 | 2/1990 | Mardon | 362/233 X |
| 4,935,853 | 6/1990 | Collins | 362/272 |
| 4,935,855 | 6/1990 | Narita | 362/286 |

*Primary Examiner*—Ira S. Lazarus
*Assistant Examiner*—Peggy Neils
*Attorney, Agent, or Firm*—Griffin Branigan & Butler

[57] ABSTRACT

A lighting apparatus of the present invention comprises a lamp which is started and lighted by a ballast and a starter and which takes an illumination position controlled by remote operation, the ballast and the starter being received in a lamp casing in which the lamp is disposed. The light apparatus is therefore capable of preventing the occurrence of noise in various kinds of electronic instrument, which is caused by the high-frequency waves generated from the ballast and other devices, and rapidly returning to its original positions from any illumination positions with respect to the illumination direction, the illumination angle and so on.

2 Claims, 6 Drawing Sheets

FOCUSABLE AND ADJUSTABLE REMOTE-CONTROLLED LIGHTING DEVICE

BACKGROUND OF THE INVENTION

1. Field of the Invention

The present invention relates to a lighting apparatus, and particularly to a lighting apparatus which uses as a light source a xenon lamp, which is capable of preventing noise from occurring in various types of electronic equipment owing to the high-frequency waves generated from ballasts and other devices, which is made compact so as to be easily installed in various kinds of ships, and which is capable of rapidly returning to its original positions with respect to lighting direction, a lighting angle and other lighting positions.

2. (Description of Related Art)

Xenon lamps which generate light similar to sunlight are suitable for lighting at night and are thus generally used as lighting apparatuses for various kinds of outdoor work at night, for example, for illumination on the sea surface from a ship and various other work related to fishing.

A ballast and a high-tension pulse generator (starter) are required for starting discharge lamps such as xenon lamps (light source). Such a ballast and starter are respectively installed at positions separate from the lamp in view of the effect of heat generated from the lamp, the capacity and other structural problems, the ballast and starter being connected to the lamp through cables.

In fishing boats and various other ships, a steering house is generally selected as the location where a ballast and so on are installed. In the steering house radio equipment, facsimile equipment and other nautical equipment are located, all of which are required for ship navigation. Various electronic equipment such as fish finders are further located on fishing boats. The ballast, the starter and the cables for a xenon lamp, which are all located in the steering house, generate high-frequency waves which cause the occurrence of noise in the above-described various types of electronic equipment. A critical problem therefore occurs concerning navigation in some cases. Further, as fishing boats and small ships have a small steering house, it is often difficult to locate the ballast, the starter and other equipment in the steering house, and equipment such as wiring and the drawing of cables is complicated.

An illuminating xenon lamp has therefore been proposed in Japanese Patent Publication No. 63-276802 in which a ballast and a starter are received in the cylindrical body of a lamp so that the whole of the body is formed as a compact unit.

On the other hand, in a lighting apparatus which uses as a light source a xenon lamp and which is installed in a ship, the setting of the lighting direction, setting of the elevation angle and adjustment of the focal distance are performed by the remote operation using a controller. Such a controlling operation enables lighting in any direction, regardless of the direction of navigation, and enables convergent lighting in a distant place and scattered lighting in the immediate area.

However, as described above, conventional xenon lighting lamps which are installed in various kinds of ships have a ballast and other devices which are located in the steering house and have an effect of generating noise in various electronic instruments and thus cause troubles in ship navigation.

The integrated xenon lighting lamp disclosed in Japanese Patent Publication No. 63-286802 is proposed for removing the disadvantages of conventional xenon lighting lamps with respect to their operation which are caused by the large size thereof and the provision of outside ballast. However, no consideration is given to a reduction in noise produced in the various kinds of electronic instruments, which are required for ship navigation, and to the use of the lamps on the sea. Namely, the noise cannot be completely removed, even by such a conventional integrated lamp, and the cylindrical form of the lamp body, which enables spontaneous cooling of the ballast and the starter received therein, makes the lamp intolerable the particular severe environment of use on the sea, which requires salt resistance and water resistance.

In addition, when the illumination direction is controlled and set by the remote operation using the controller, if the illumination direction differs from the navigation direction, after the controlling operation, it is necessary for returning to the original position along the navigation direction to precisely recognize the present position and control the illumination direction corresponding to the present position. Such a controlling operation thus takes much time.

Accordingly, it is an object of the present invention to provide a lighting apparatus which has been created in consideration of the aforementioned situation, which has a compact overall structure having a ballast and a starter, which are received in a lamp casing for receiving various lamps such as a xenon lamp serving as a light source so that the apparatus can be easily installed in various kinds of ships, which is capable of preventing noise form occurring in various kinds of electronic instrument owing to the high-frequency waves generated from the ballast and other devices, and which exhibits speeded-up return of any illumination positions from the original positions after the illumination direction, the illumination angle and other illumination positions have been adjusted and set.

In order to achieve the above object, a lighting apparatus of the present invention comprises a lamp which is started and lighted by a ballast and a starter, and takes illumination positions which are controlled by remote operation, the ballast and the starter being received in a lamp casing in which the lamp is disposed.

The lighting apparatus comprises a lamp which takes illumination positions operated by the remote operation using an operating device having reset means which is provided therein for the purpose of returning the lamp, which has been adjusted to be in a given turning position and a given elevation position, to the original turning and elevation positions.

In the lighting apparatus of the present invention, the lamp casing containing the lamp is installed at the bridge or another predetermined position of a ship, while the operating section of the operating device is installed in a remote operation place such as the steering house.

The operating device brings the apparatus into a ready condition and lights the lamp such as a xenon lamp. The lamp is smoothly started by the ballast and the starter which are received in the lamp casing. Hence various kinds of electronic instrument which are located in the steering house, which is the remote operation place, are not affected by the high-frequency waves generated by the ballast and the starter.

When a turning switch in the operating section is operated, a turning motor is driven so that the lamp is clockwisely or counterclockwisely turned.

When an elevation switch in the operating section is operated, an elevation motor is driven so that the lamp is turned upward and downward in the vertical direction.

In addition, when an origin return switch in the reset means is turned on, the turning motor and the elevation motor are respectively driven toward the original positions in the direction from the set turning stop position to the original turning position, and in the direction from the set elevation stop position to the original elevation position. When the original turning position and the elevation original position are detected, the turning motor and the elevation motor are stopped so that the lamp is returned to the original position and stopped at the original position and is made ready for a next operation.

BRIEF DESCRIPTION OF THE DRAWINGS

The attached drawings show an embodiment of the present invention, in which.

DETAILED DESCRIPTION OF PREFERRED EMBODIMENT

Figure 1:
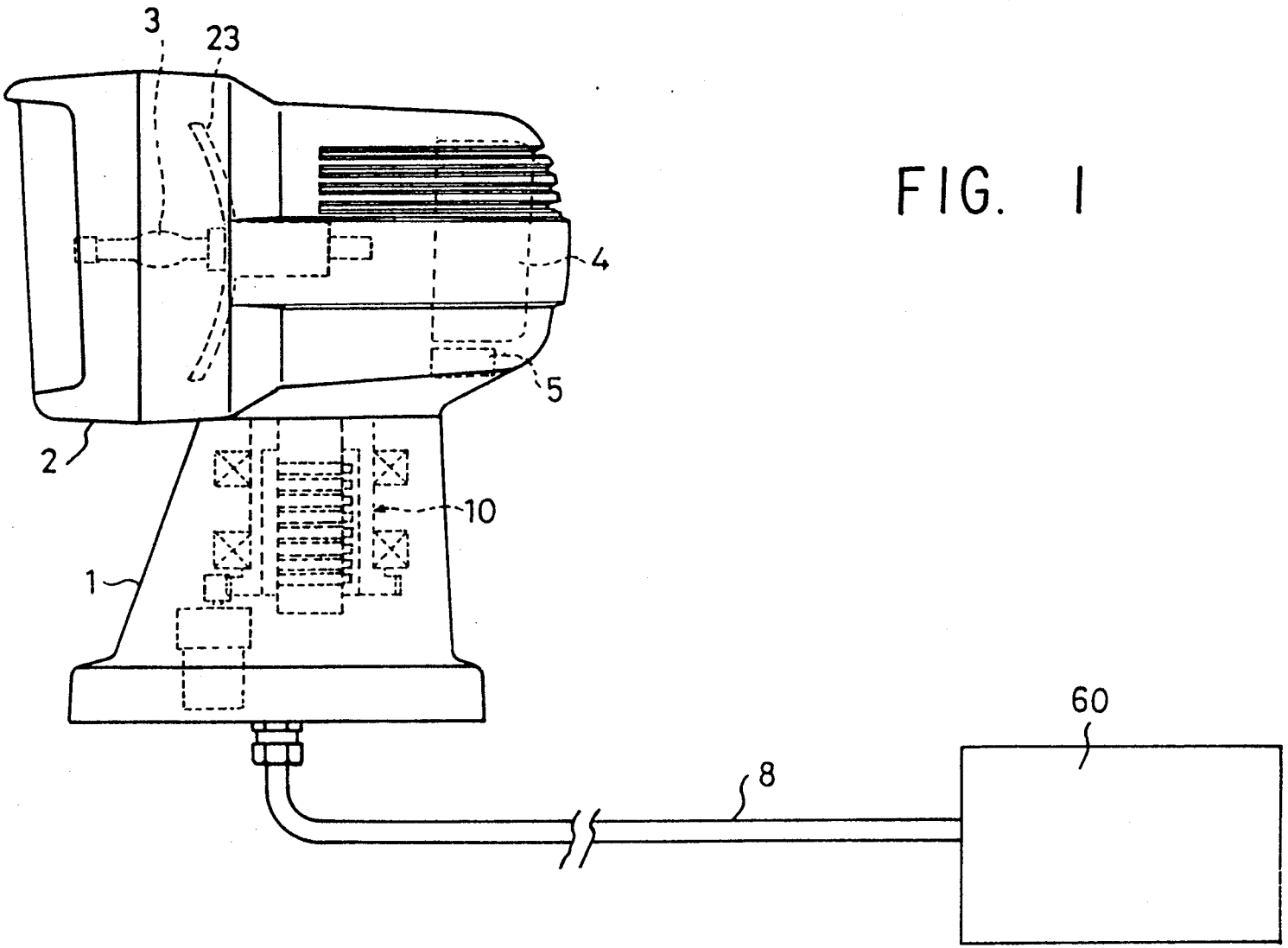
FIG. 1 is a schematic side view of an embodiment.

An embodiment of the present invention is described below with reference to the drawings.

In the drawings, reference numeral 1 denotes a stand which is erectly fixed in the bridge of a ship (not shown) or another predetermined position thereof, a lamp casing 2 being disposed and fixed on the stand 1 so that it can be rotated by the turning device 10 provided in the stand 1.

In the lamp casing 2 are disposed a discharge-type lamp 3 such as a xenon lamp, a ballast 4 and a starter 5. The focal distance of the lamp 3 can be adjusted by a focusing mechanism 30 which forwardly and backwardly slides the lamp 3, and the illumination angle in the vertical direction can be adjusted by an elevating device 50 which oscillates the lamp 3.

The turning by the turning device 10, the focusing by the focusing mechanism 30 and the setting of an elevation angle by the elevating device 50 are controlled by remote operation, for example, using an operating device (controller) 60 which is set in the steering house or another place. The operation of reset means 67, 77, 78, 81 and 82 of the operating device 60 causes the return of the lamp 3 to the original position.

(Stand)

The stand 1 is formed into a substantially cylindrical shape in a closed structure having a mounting flange at the bottom thereof so that it can be fixed at a predetermined position, a cable 8 being led out of the bottom of the stand 1 and connected to the operating device 60.

(Turning device)

The turning device 10 provided in the stand 1 turns the lamp casing 2 clockwise or counterclockwise by using the driving force of the turning motor 11.

Figure 2:
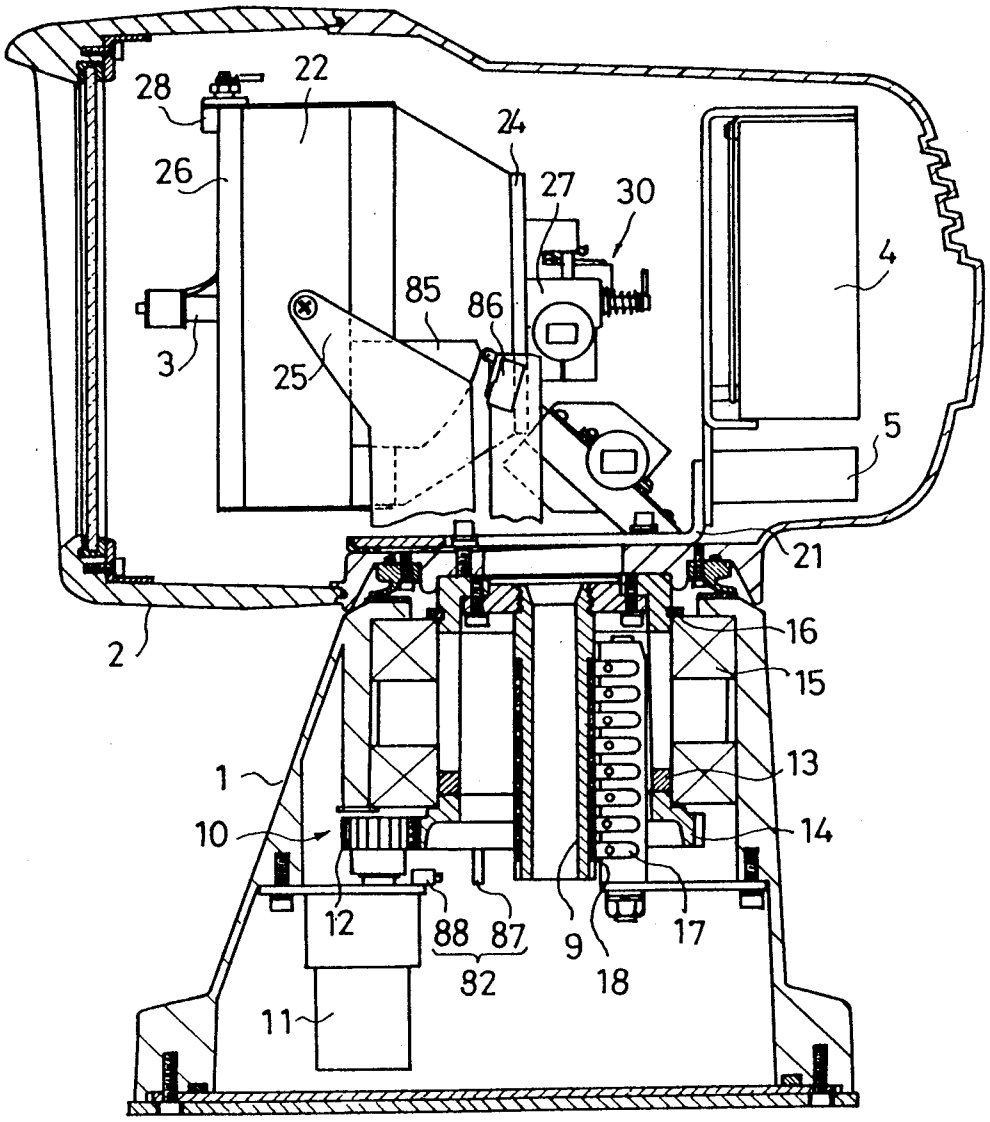
FIG. 2 is a sectional side view of the same embodiment.

Namely, as shown in FIG. 2, the turning device 10 comprises the turning motor 11 which is rotatably fixed in the stand 1, a driving gear 12 fixed to the motor shaft of the turning motor 11, a driven gear 14 fixed to the circumference of the turning shaft 13 connected to the lamp casing 2, and a bearing 15 rotatably supporting the turning shaft 13. Waterproofing is provided by interposing an O-ring 16 or the like between the upper opening of the stand 1 and the lower surface of the lamp casing 2 so as to prevent water droplets or dust particles from entering the stand 1 and the lamp casing 2.

Further, slip rings 17 are disposed in the vertical direction on the circumference of a center shaft 9, which does not rotate, in the turning shaft 13 so as to control the driving of motors 31, 51 of the focusing mechanism 30 and the elevating device 50, respectively, and to provide electrical connection for supplying electricity to the lamp 3. A brush 18 which contacts with the slip rings 17 is also provided in the turning shaft 13.

(Lamp casing)

The lamp casing 2 is formed into the form of a rectangular prism having a closed structure which is waterproofed, wholly rounded and slightly flat. The lamp 3 is disposed in the front portion of the lamp casing 2 which is transparent and has an open front side, and the ballast 4 and the starter 5 are received in the rear portion of the lamp casing 2 which has a substantially fin-like shape that can radiate heat as occasion demands (refer to FIGS. 1 and 2).

The lamp 3 such as the xenon lamp disposed in the lamp casing 2 is passed through and supported by a reflecting mirror 23 which has a U-shaped front side and which is fixed in the mirror holder 22 supported by an elevation base 21 fixed to the lamp casing 2.

The mirror holder 22 is formed in a substantially bob-like shape having a front side which is widely opened and a rear side which is connected to a lamp base plate 24. The mirror holder 22 is also rotatably held between right and left mirror supporting plates 25 which are erectly provided on both sides of the elevation base 21.

The reflecting mirror 23 is fixed and supported by the front end of the mirror holder 22 through a mirror clamper 26.

The lamp 3 is connected and supported between an anode terminal portion 6 disposed in a lamp shield cap 27 fixed to the lamp base plate 24 and a cathode terminal portion 7 connected to a cathode terminal 28 fixed at an upper end in the front of the mirror holder 22.

The focusing operation can be performed by using the focusing mechanism 30 which forwardly and backwardly moves the lamp 3 itself, and the lamp itself can be turned up and down by the elevating device 50 which turns the mirror holder 22 up and down.

(Focusing mechanism)

Figure 3:
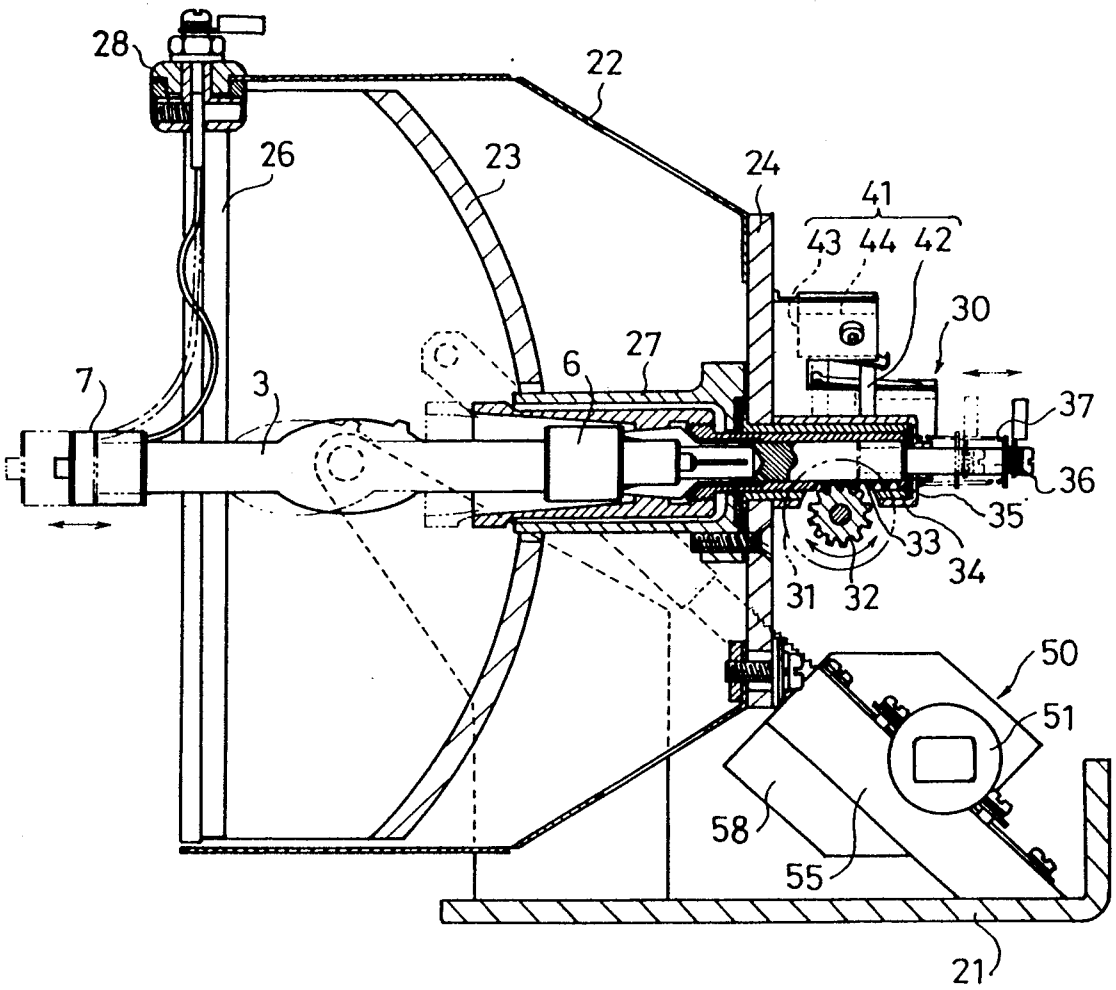
FIG. 3 is a sectional view of a principal portion provided for explaining a focusing mechanism.
Figure 4:
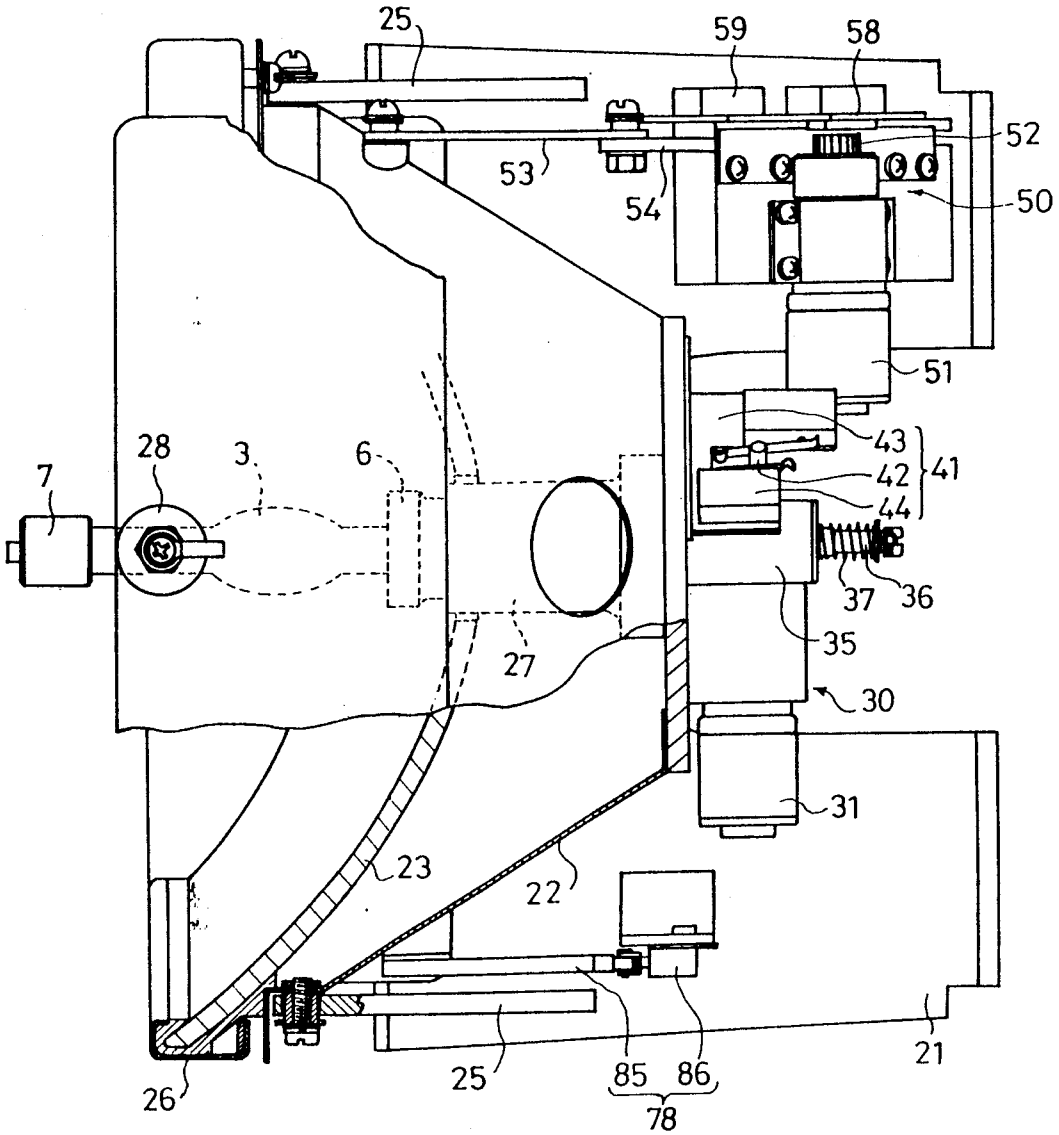
FIG. 4 is a partially cut-away plan view of the principal portion.

As shown in FIGS. 3 and 4, the focusing mechanism 30 comprises a focusing motor 31 fixed to the rear side of the lamp base plate 24, a focusing pinion 32 secured to the motor shaft of the focusing motor 31, and a focusing driving rack 33 to which the anode terminal portion 6 is connected and which engages with the focusing pinion 32 so as to move forward and backward.

As shown in the drawings, the focusing driving rack 33 is received in a rack housing 34 fixed to the rear side of the lamp base plate 24 so as to be slidable forward and backward, the rack housing 34 being covered with a rack shield cap 35. An adjustment pin 36 projected outward from the rack shield cap 35 is connected to the rear end of the focusing driving rack 33 so that the focusing driving rack 33 is elastically urged backward by the elastic force of the focusing coil spring 37 contracted and mounted on the adjustment pin 36.

If the focusing driving rack 33 is forwardly slid by driving the focusing motor 31 through the focusing pinion 32, therefore, the anode terminal portion 6 in the lamp shield cap 27 is forwardly slid. As a result, the position of the lamp 3 can be adjusted by forward and backward movement. At this time, if the lamp is slid forward, convergence of light takes place and enables illumination in a remote place, while if the lamp is slid backward, scattering of light takes place and thus enables illumination in the neighborhood.

Reference numeral 41 denotes a limit means which has the focusing limit shaft 42 fixed to the focusing driving rack 33 so as to stop the driving of the focusing motor 31 by turning on and off one of two limit switches 44, which are disposed corresponding to the front and rear limit positions through a limit switch mounting plate 43 provided on the back of the lamp base plate 24.

(Elevating device)

Figure 5:
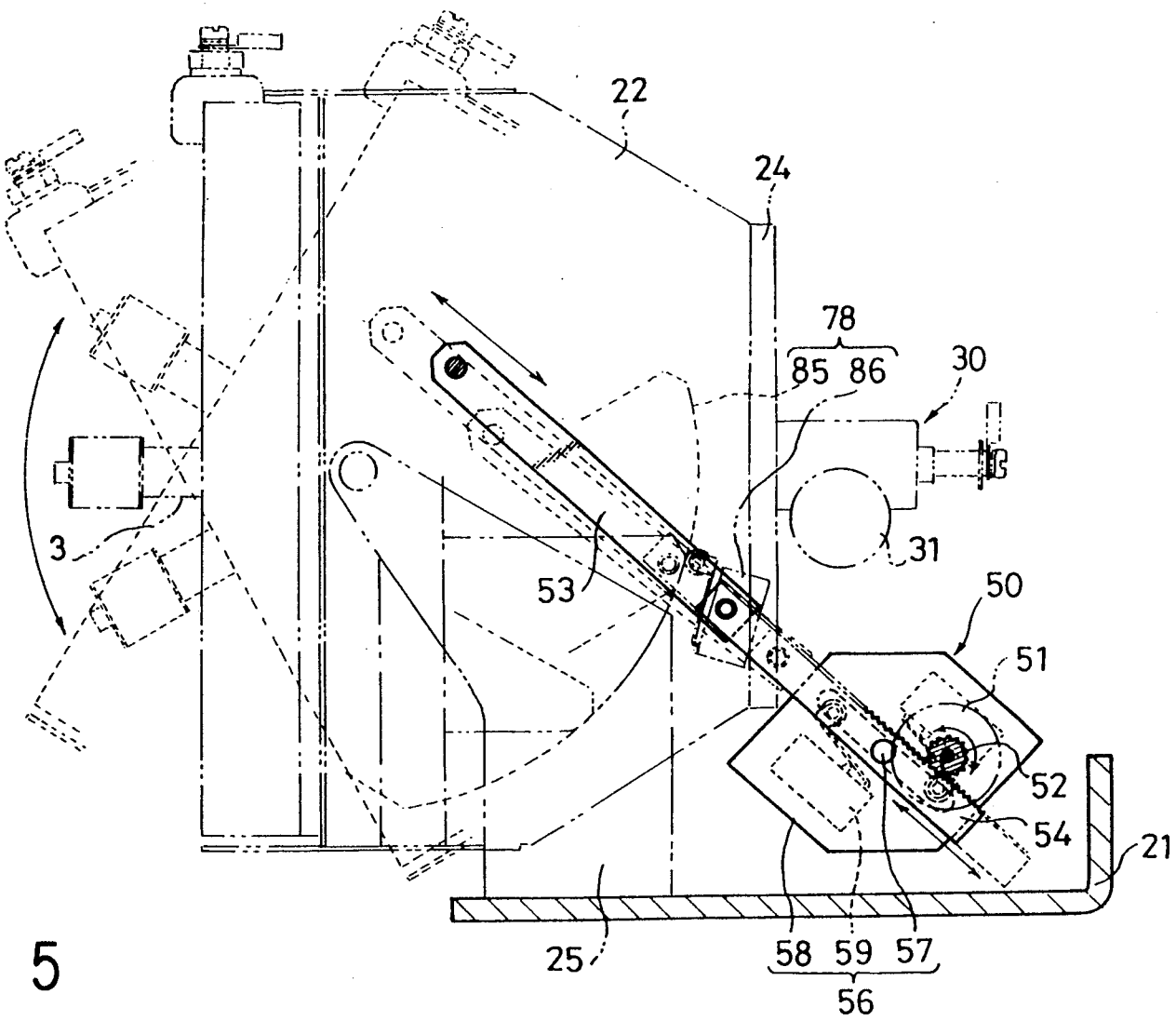
FIG. 5 is a side view of the principal portion provided for explaining an elevation mechanism.

The elevating device 50 comprises an elevation motor 51 disposed on the elevation base 21, an elevation pinion 52 fixed to the motor shaft of the elevation motor 51, and an elevation driving rack 54 which is rotatably connected to an elevation link 53 having one end pivotally connected to the mirror holder 22 and which engages with the elevation pinion 52 so as to forwardly and backwardly move, as shown in FIGS. 3 to 5.

The elevation driving rack 54 is also received in a rack housing 55 provided on the elevation base 21 so as to be slidable forward and backward, as shown in the drawings.

When the elevation driving rack 54 is slid forward or backward by driving the elevation motor 51 through the elevation pinion 52, therefore, the mirror holder 22 pivotally supported by the mirror supporting plates 25 can be oscillated in the vertical direction around this support position serving as the center. At this time, if the elevation driving rack 54 is forwardly slid, the mirror holder 22 is turned downward, while if the elevation driving rack 54 is backwardly slid, the mirror holder 22 is turned upward.

In the drawings, reference numeral 56 denotes a limit means which has an elevation limit shaft 57 fixed to the elevation driving rack 54 for the purpose of turning on and off two limit switches 59 disposed corresponding to the upper and lower limit positions through a limit switch mounting plate 58 provided on the rack housing 55 so as to stop the driving of the elevation motor 51.

(Operating device)

The turning by the turning device 10, the focusing operation by the focusing mechanism 30 and the elevation by the elevating device 50 are performed by the operating device 60 located, for example, in the steering house or another place.

As shown in FIG. 1, the operating device 60 has a control panel (controller) 61 which is connected to the stand 1 through the cable 8 and operated by using various switches provided thereon. In addition, any illumination positions can be returned to the original position by operating the reset means (67, 77, 78, 81, 82).

Figure 6:
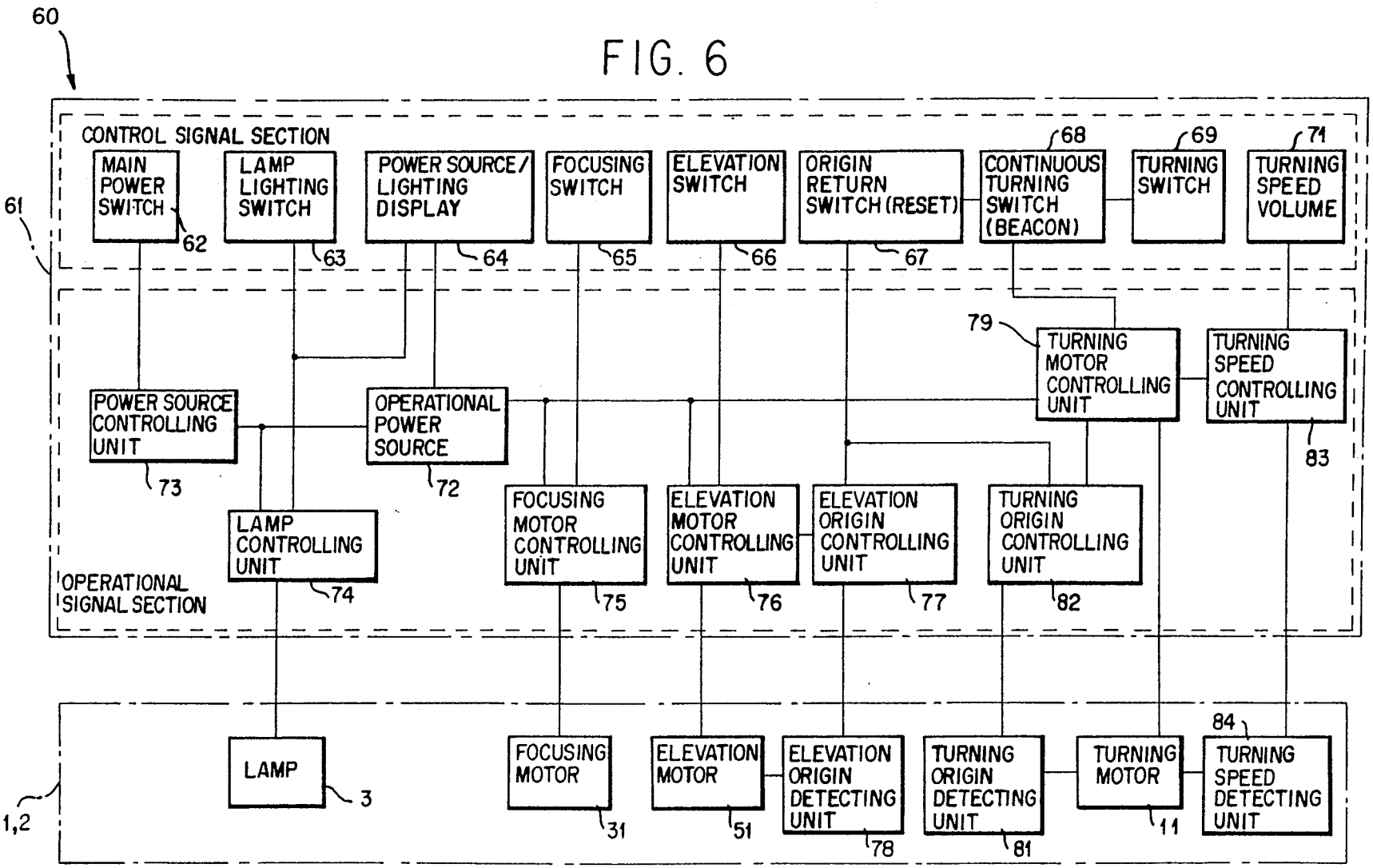
FIG. 6 is a drawing of a control circuit of an operating device.

Namely, as shown in FIG. 6, in the control signal section of the control panel 61 are disposed a main power switch 62 for turning the power source on, a lamp lighting switch 63 for lighting the lamp 3, a power source and lighting display unit 64, a focusing switch 65 for operating the focusing mechanism 30, an elevation switch 66 for operating the elevating device 50, an origin return switch (reset) 67 for returning an illumination position to the original position, a continuous turning switch (beacon) switch 68 for continuously operating the turning device 10, and a turning speed volume 71 for adjusting the turning speed of the turning device 10.

An operation controlling section has various controlling units which are connected to an operation power source 72.

A power controlling unit 73 is connected to the main power switch 62.

A lamp controlling unit 74 is connected to the lamp lighting switch 63.

A focusing motor controlling unit 75 is connected to the focusing switch 65 and the focusing motor 31.

An elevation motor controlling unit 76 is connected to the elevation switch 66 and the elevation motor 51.

An elevation origin controlling unit 77 is connected to the origin return switch 67, the elevation motor controlling unit 76, and an elevation origin detecting unit 78 for detecting the original position of the elevation motor 51.

A turning motor controlling unit 79 is connected to the continuous turning switch 68 and the turning motor 11.

A turning origin control unit 81 is connected to the origin return switch 67, the turning motor controlling unit 79 and a turning origin detecting unit 82 for detecting the original position of the turning motor 11.

A turning speed controlling unit 83 is connected to the turning speed volume 71, the turning motor controlling unit 79 and a turning speed detecting unit 84 for detecting the turning speed of the turning motor 11.

The control panel 61 is divided into a control signal section board and an operation controlling section board. When an attempt is made to enable parallel controlling operation from a plurality positions, for example, controlling operation from the deck, the bridge and other places outside the steering house, a plurality of operation controlling section boards can be disposed corresponding to the operating positions.

As shown in FIGS. 2 and 5, when the origin return switch 67 is turned on, the elevation origin detecting unit 78 detects the original position when a microswitch 86 is turned on or off by the elevation origin detecting plate 85, which is placed on the mirror holder 22 oscillated by the elevation motor 51 of the elevation device 50, which is always driven toward the original position, so that the circuit of the elevation motor 51 is turned off.

As shown in FIG. 2, when the origin return switch 67 is turned on, the turning origin detecting unit 82 detects the original position when the microswitch 88 is turned on or off by a turning origin detecting pin 87 placed on the turning shaft 13, which is turned by the turning motor 11 of the turning device 10 driven in a predetermined direction, so that the circuit of the turning motor 11 is turned off.

When the reset means is operated, i.e., when the origin return switch 67 is turned on, therefore, any illumination positions with respect to the horizontal illumination direction and the vertical illumination angle can be returned to the original position. At the same time, the turning device 10 rotates the turning motor 11 in a given direction and causes the turning origin detecting unit 82 to detect the original position through the turning origin controlling unit 81 so as to stop the turning motor 11 and return the lamp casing 2 to the original position. In the elevating device 50, the elevation motor 51 is rotated in a predetermined direction, and the original position is detected by the elevation origin detecting unit 78 through the elevation origin controlling unit 77 so that the elevation motor 51 is stopped, and the mirror holder 22 is returned to the original position.

Such rest means can be used for the discharge-type lamp and any other lamps having any illumination structures such as an incandescent type and the like, and the lamp used should not be limited to the xenon lamp shown in the drawings.

(Example of operation)

In the apparatus of the present invention, the lamp casing 2 is installed by the stand 1 at a given position of a ship such as the bridge or another position, while the control panel 1 is installed in a remote operation place such as the steering house.

The ready condition is produced by turning the main power switch 62 on in the operating device 60, and the lamp is lighted by turning the lamp lighting switch 63 on. The lamp 3 such as the xenon lamp is smoothly actuated by the ballast 4 and the starter 5 which are received in the lamp casing 2. The high-frequency waves generated from the ballast 4 and the starter 5 have no effect on the various kinds of electronic instrument which are disposed in the steering house or the like.

The focusing operation and the illumination direction, the illumination angle and other illumination states are controlled by remote operation using the various switches 65, 66, 67, 68, 69 and the volume 71.

When the turning motor 11 is operated by the turning switch 69 through the turning motor control unit 79, the lamp 3 turns clockwise or counterclockwise. At this time, the turning speed can be adjusted by operating the turning speed volume 71, and continuous turning can be performed by operating the continuous turning switch 68.

The lamp 3 is moved forward and backward with respect to the reflecting mirror 23 by operating the focusing motor 31 through the focusing motor control unit 75 by using the focusing switch 65. During this operation, if the lamp 3 is forwardly slid, convergence of light takes place and causes illumination in a remote place, and if the lamp 3 is backwardly slid, scattering of light takes place and causes illumination in the neighborhood.

The lamp 3 is vertically oscillated by operating the elevation motor 51 through the elevation motor controlling unit 76 by using the elevation switch 66.

When the turning motor 11 and the elevation motor 51 are driven by turning the origin return switch 67 on and when the original position is then detected by the turning origin detecting unit 82 and the elevation origin detecting unit 78, the turning motor 11 and the elevation motor 51 are stopped and returned to the original turning position and the original elevation position, respectively, so as to ready for the next operation.

In the present invention arranged as described above, since the ballast 4 and the starter 5 which are used for actuating and lighting the lamp 3, are received in the lamp casing 2, the high-frequency waves generated from the ballast 4 and the starter 5 have no effect of generating noise in, for example, the various types of electronic instrument which are required for navigation. That is, the various types of electronic instrument which are required for navigation are installed in the steering house or another place, while the lamp casing receiving the ballast 4 and the starter 5 of the lighting apparatus of the present invention is installed at a position such as the bridge or another position which is separated from the steering house. There is thus no room for the occurrence of noise in the various types of electronic instrument owing to the high-frequency waves.

Furthermore, since the ballast 4 and the starter 5 are received in the lamp casing 2 in which the lamp is disposed, the whole of the apparatus can be arranged in a compact form. It is therefore unnecessary to dispose the ballast 4 and the starter 5 and so on in the small steering house during outfitting and consequently draw around wiring. The outfitting work can be thus performed with good efficiency, and the small steering house can be effectively employed.

The operating device 60 for remote control of the illumination position of the lamp 3 is provided with the reset means 67, 77, 78, 81, 82 for returning the lamp 3, which has been adjusted to be in a given turning position and elevation position, to the turning and elevation original positions. The lamp in any illumination position can thus be returned to the original position, for example, the position where the lamp 3 horizontally faces the front of a ship along the direction of navigation thereof, by one-touch operation of the reset means even if the lamp 3 is in any turning position and elevation position.

What is claimed is:

1. In a remote-controlled lighting device having a lighting member comprised of a stationary mounting means and a turnable casing mounting thereon, wherein the casing contains a movable illumination lamp, a ballast for said lamp, a starter for said lamp and moving means for moving said lamp from an original position to a moved position, and wherein the device has reset means for returning the lamp from the moved position to the original position, the improvement wherein a focusing means for adjusting the illumination focus of the lamp is provided in said casing, said focusing means comprising:

(a) a mirror holder;
(b) a mirror disposed in said holder;
(c) a lamp disposed adjacent said mirror;
(d) a lamp base plate for retaining said lamp on a front side of said mirror, said base plate being attached to a rear portion of said mirror holder;
(e) a rack housing fixed to a back side of said base plate;
(f) a focusing driving rack disposed in said rack housing for forward and backward sliding movement of said drive rack in said rack housing, wherein one end of the drive rack is operably connected to said lamp;
(g) a motor-drivable focusing pinion meshed with said drive rack for moving said drive rack forwardly and backwardly in said rack housing; and
(h) a focusing coil spring disposed in relation to said drive rack so as to urge the drive rack backwardly.

2. In a remote-controlled lighting device having a lighting member comprised of a stationary mounting means and a turnable casing mounted thereon, wherein the casing contains a movable illumination lamp, a ballast for said lamp, a starter for said lamp and moving means for moving said lamp from an original position to a moved position, and wherein the device has reset means for returning the lamp from the moved position to the original position, the improvement wherein an elevation means for adjusting the elevation of the lamp is provided in said casing, said elevation means comprising:

(a) a rack housing disposed on an elevation base, which elevation base is fixed to said casing;

(b) a mirror holder;

(c) a mirror disposed in said holder;

(d) a lamp disposed adjacent said mirror;

(e) a mirror holder support plate disposed on each side of the mirror holder and a first end of the said support plate being pivotably attached to a side of the mirror holder and a second end attached to said elevation base;

(f) an elevation link having one end pivotably attached to the mirror holder;

(g) an elevation driving rack rotatably connected to said elevation link and disposed in a rack housing so as to be forwardly and backwardly slidable in said rack housing; and (h) a motor-drivable elevation pinion meshed with said driving rack so as to move said mirror holder to different elevations thereof.

* * * * *